US008378242B2

(12) United States Patent
Kim

(10) Patent No.: US 8,378,242 B2
(45) Date of Patent: Feb. 19, 2013

(54) CIRCUIT BREAKER WITH REBOUND PREVENTER

(75) Inventor: Dae Seong Kim, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 449 days.

(21) Appl. No.: 12/645,783

(22) Filed: Dec. 23, 2009

(65) Prior Publication Data

US 2010/0230261 A1 Sep. 16, 2010

(30) Foreign Application Priority Data

Mar. 11, 2009 (KR) ..... 10-2009-0020900

(51) Int. Cl.
*H01H 3/60* (2006.01)

(52) U.S. Cl. ..... 200/288; 200/401

(58) Field of Classification Search ..... 200/288
See application file for complete search history.

(56) References Cited

U.S. PATENT DOCUMENTS 4,855,549 A * 8/1989 Toda et al. ..... 200/401
6,787,725 B2 9/2004 Kim et al.
6,884,949 B2 4/2005 Yoon
7,227,279 B2 6/2007 Kim

OTHER PUBLICATIONS

U.S. Appl. No. 12/633,827, to Park, filed Dec. 9, 2009.
U.S. Appl. No. 12/633,863, to Kim et al., filed Dec. 9, 2009.
U.S. Appl. No. 12/635,911, to Woo, filed Dec. 11, 2009.
U.S. Appl. No. 12/641,769, to Kim, filed Dec. 18, 2009.
U.S. Appl. No. 12/641,946, to Seo, filed Dec. 18, 2009.
U.S. Appl. No. 12/645,620, to Kim et al., filed Dec. 23, 2009.
U.S. Appl. No. 12/651,501, to Tak et al., filed Jan. 4, 2010.

* cited by examiner

*Primary Examiner* — Renee Luebke
*Assistant Examiner* — Lheiren Mae Caroc
(74) *Attorney, Agent, or Firm* — Greenblum & Bernstein P.L.C.

(57) ABSTRACT

A circuit breaker having a stopping groove engaged with part of the main shaft and a rebound preventer rotatably installed in the circuit breaker. The stopping groove includes first and second contact surfaces contactable with the part of the main shaft upon the rotation of the main shaft. Further, an extending line of a force applied from the part of the main shaft to the second contact surface passes through the center of the rotation of the rebound preventer upon a reverse rotation of the main shaft.

5 Claims, 5 Drawing Sheets

CIRCUIT BREAKER WITH REBOUND PREVENTER

CROSS-REFERENCE TO A RELATED APPLICATION

Pursuant to 35 U.S.C. §119(a), this application claims the benefit of earlier filing date and right of priority to Korean Application No. 10-2009-0020900, filed on Mar. 11, 2009, the contents of which is incorporated by reference herein in its entirety.

BACKGROUND OF THE INVENTION

1. Field of the Invention

The present invention relates to a circuit breaker with a rebound preventer, and particularly, to a circuit breaker having a mechanism for preventing rebound upon a trip operation of the circuit breaker for protecting a circuit from over-current or short circuit.

2. Background of the Invention

A circuit breaker is an electric device installed on an electric circuit for safely blocking current to protect power systems and power equipment when the circuit is forcibly open or closed in a normally used state or when a fault current such as earth fault current or short circuit current. Typically, a circuit part of the circuit breaker may be provided with a spring and a rigid body, so as to enable fast operation upon opening a circuit. A trip mechanism of the circuit breaker is partially shown in FIGS. 1 and 2.

FIG. 1 is a side view showing a side surface of part of the trip mechanism, and FIG. 2 is a font view thereof. As shown in FIGS. 1 and 2, the circuit breaker 10 may include a movable contact 12 disposed therein. The movable contact 12 may be contactable with or separated from a fixed contact which is not shown so as to perform a trip operation. A push rod 14 formed of an insulating material may be connected to an end portion of the movable contact 12, and another end portion of the push rod 14 may be connected to an end portion of a main shaft 18 by interposing a contact spring 16 therebetween.

The main shaft 18 may be rotatably disposed based upon a rotation shaft 20, and a trip spring 22 may be connected near another end portion of the main shaft 18. The trip spring 22 and the contact spring 16 may serve to rotate the main shaft 18 in a clockwise direction in FIG. 1 upon a trip operation.

In the meantime, the rotation of the main shaft 18 is restricted within a prescribed range by a damping element. The another end portion of the main shaft 18 is connected to a rotation link 26 via a rod 24, and the rotation of the rotation link 26 is restricted within a prescribed range by a stop block 28. Therefore, when the main shaft 18 is rotated in a clockwise direction, the rod 24 is moved upwardly in FIG. 2. Accordingly, the rotation link 26 is rotated in a counterclockwise direction, and then stopped by the stop block 28.

However, actually, the rotation link 26 is crushed against the stop block 28 by a repulsive force, for example, to be thereafter moved in an opposite direction. Accordingly, an interval (gap) between the movable contact 12 and the fixed contact becomes narrower, which is referred to as 'rebound.' Such rebound is repeated plural times with gradually decreasing amplitude thereof. Consequently, insulation between poles cannot be maintained, resulting in an incomplete trip operation.

To avoid such problem, the stop block 28 is provided with an oil dash pot, accordingly the rebound can be decreased by an attenuation of the oil dash pot. The oil dash pot uses the attenuation due to oil contained therein. However, when a small amount of oil is contained, such oil can absorb a great impact but an excessively long time is required until the impact is attenuated. On the other hand, when a large amount oil is contained, the rebound quantity is increased. That is, as shown in FIG. 3, it can be noticed that for a small amount of oil, a relatively short time is spent until vibration due to the rebound is completely attenuated but an amount of strokes is increased. It can also be noticed that for a large amount of oil, the amount of strokes is decreased but time required until the vibration due to the rebound is completely attenuated is lengthened (see FIG. 4).

Furthermore, since an amount of impact adsorbed by the oil dash pot is not constant, the rebound quantity cannot be controlled as a designer wants to. Also, as time elapses, the property of the oil dash pot is changed due to oil is leakage or the like. In addition, if the circuit breaker becomes larger in size as currently does, an amount of impact occurred upon the trip operation is also increased. Accordingly, the oil dash pot has to become larger in size, but there is limitation of the size due to economical and spatial limits.

SUMMARY OF THE INVENTION

Therefore, to overcome the drawbacks of the related art, an object of the present invention is to provide a circuit breaker having a rebound preventer capable of effectively preventing rebound upon a trip operation of the circuit breaker.

To achieve these and other advantages and in accordance with the purpose of the present invention, as embodied and broadly described herein, there is provided a circuit breaker including, a main body, a fixed contact fixed to the main body, a movable contact contactable with or separated from the fixed contact, the movable contact being movably installed at the main body, a main shaft connected to one side of the movable contact, the main shaft being rotatably installed on the main body, a trip mechanism coupled to another side of the main shaft and configured to rotate the main shaft, and a rebound preventer having one end rotatably installed on the main body and provided with a stopping unit formed at another end thereof and engaged with the main shaft, wherein the rebound preventer is rotated with being engaged with the main shaft, and the stopping unit restricts a reverse rotation of the main shaft in a state where the rebound preventer has been rotated over a prescribed range.

Preferably, the stopping unit may be a stopping groove formed at the is rebound preventer, and the main shaft may have a protrusion engaged with the stopping groove. Here, the stopping groove may have a width widened from an inlet thereof toward the inside.

The stopping groove may include a first contact surface contactable with the protrusion upon a forward rotation of the rebound preventer, and a second contact surface facing the first contact surface, and an end of the first contact surface may extend more outwardly than an end of the second contact surface. Here, the first contact surface may be configured as a curved surface with an arcuate shape. Also, the second contact surface may be provided with a non-continuous surface extending toward the first contact surface.

In another aspect of the present invention, there is provided a circuit breaker including, a main body, a fixed contact fixed to the main body, a movable contact contactable with or separated from the fixed contact, the movable contact being movably installed at the main body, a main shaft connected to one side of the movable contact, the main shaft being rotatably installed on the main body, a trip mechanism coupled to another side of the main shaft and configured to rotate the main shaft, and a rebound preventer having one end rotatably installed on the main body and provided with a stopping unit formed at another end thereof and engaged with the main shaft, wherein the stopping unit is provided with a stopping groove including first and second contact surfaces facing each other, wherein the first contact surface comes in contact with a part of the main shaft when separating the movable contact so as to rotate the rebound preventer in a direction opposite to the main shaft being rotated, wherein the second contact surface restricts a reverse rotation of the main shaft when the same comes in contact with the part of the main shaft in a state where the rebound preventer has been rotated over a prescribed range.

Preferably, an end of the first contact surface may extend more outwardly than an end of the second contact surface. Here, the first contact surface may be configured as a curved surface with an arcuate shape.

In another aspect of the present invention, there is provided a circuit breaker in which a trip mechanism and a movable contact are connected respectively to both ends of a main shaft, the main shaft rotatably installed in a main body, so as to perform a trip operation by transferring a tensile force of the trip mechanism to the movable contact, the circuit breaker including, a stopping groove engaged with part of the main shaft, and a rebound preventer rotatably installed in the circuit breaker, wherein the stopping groove comprises first and second contact surfaces contactable with the part of the main shaft upon the rotation of the main shaft, wherein an extending line of a force applied from the part of the main shaft to the second contact surface passes through the center of the rotation of the rebound preventer upon a reverse rotation of the main shaft.

Here, the main shaft may be provided with a protrusion inserted into the stopping groove upon the forward and reverse rotations thereof.

In another aspect of the present invention, there is provided a circuit breaker in which a trip mechanism and a movable contact are connected respectively to both ends of a main shaft, the main shaft rotatably installed in a main body, so as to perform a trip operation by transferring a tensile force of the trip mechanism to the movable contact, the circuit breaker including, a stopping groove engaged with part of the main shaft, and a rebound preventer rotatably installed in the circuit breaker, wherein the stopping groove comprises first and second contact surfaces contactable with the part of the main shaft upon the rotation of the main shaft, wherein a reverse rotation of the main shaft is not available in a state where the part of the main shaft comes in contact with the second contact surface.

In accordance with the aspects of the present invention having such configurations, rebound due to a repulsive force after a trip operation can be prevented by the rebound preventer, resulting in improvement of reliability of the trip operation.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a circuit breaker in accordance with the present invention, with reference to the accompanying drawings.

Figure 5:
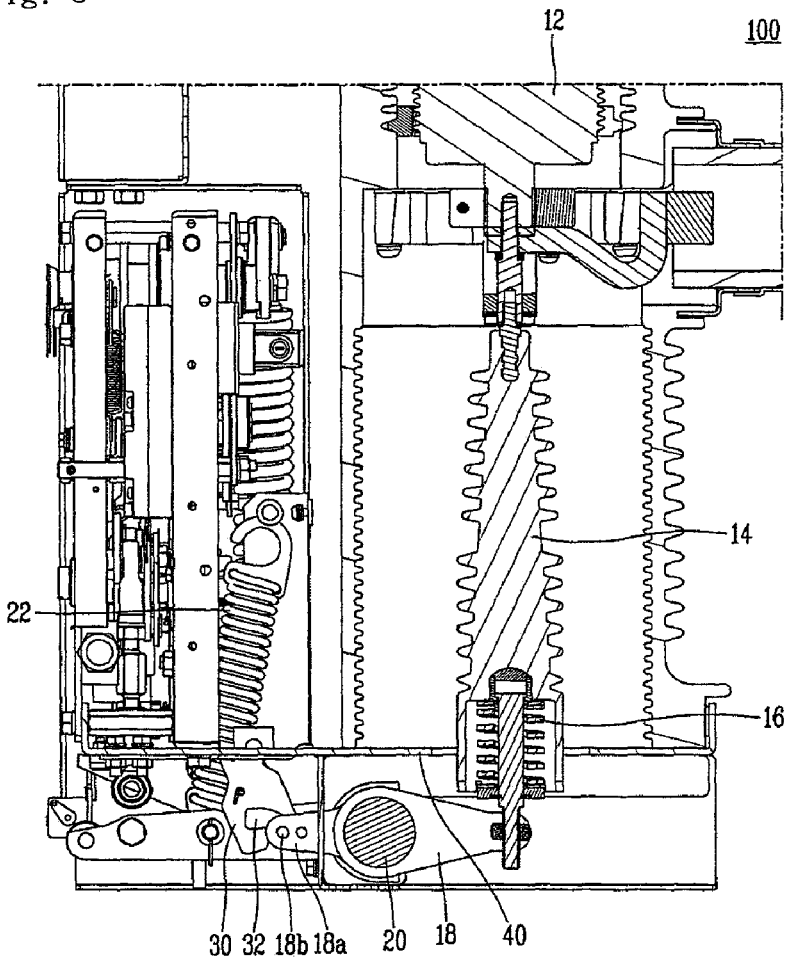
FIG. 5 is an equivalent view of FIG. 1 showing one embodiment of the circuit breaker in accordance with the present invention.

FIG. 5 shows one embodiment of a circuit breaker in accordance with the present invention. The description herein will have the same reference numerals for the same components to those shown in the embodiment of FIGS. 1 and 2, so as to omit the repeated description.

Figure 1:
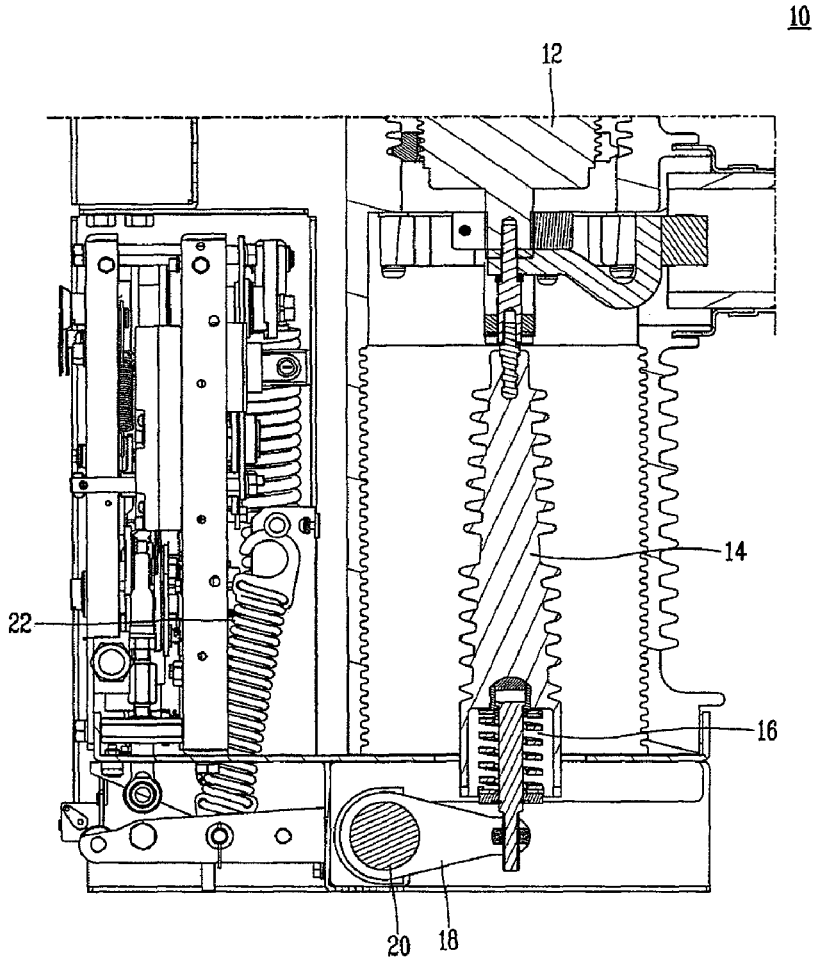
FIG. 1 is a side view showing a typical circuit breaker according to the related art.
Figure 2:
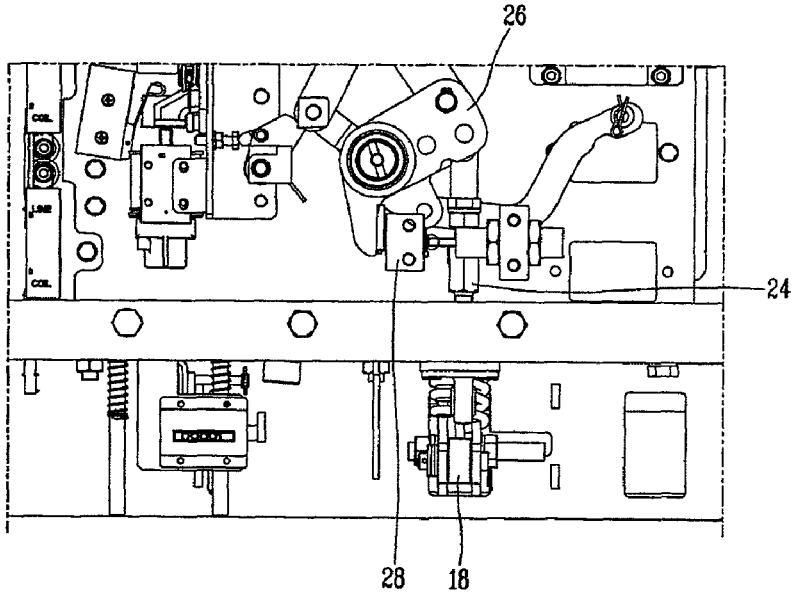
FIG. 2 is a front view of the circuit breaker shown in FIG. 1.
Figure 3:
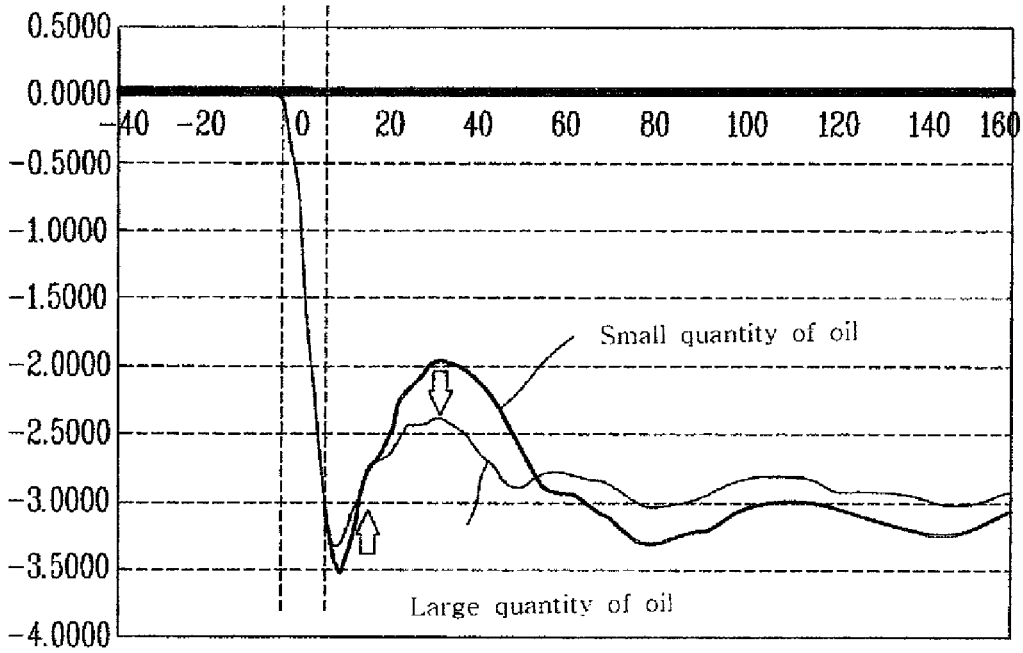
FIG. 3 is a graph showing a relationship between an oil quantity and a rebound quantity in the circuit breaker shown in FIG. 1.
Figure 4:
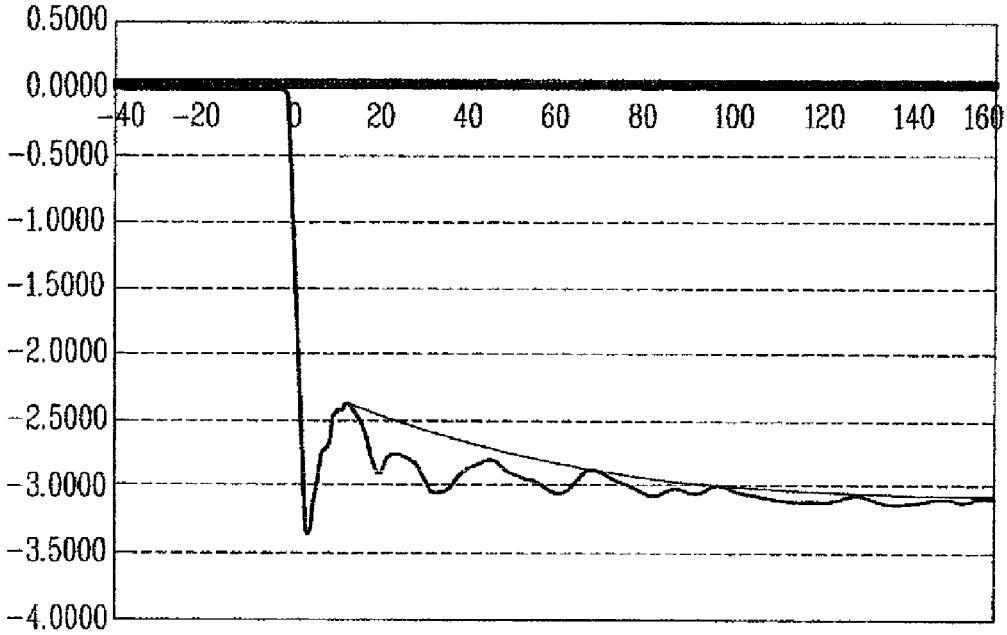
FIG. 4 is an enlarged graph showing a case of a small quantity of oil of the is graph shown in FIG. 3.

A circuit breaker 100 according to the embodiment shown in FIG. 5 basically has the similar structure to the circuit breaker of the embodiment shown in FIG. 1. However, the circuit breaker 100 in accordance with the embodiment may include a catch lever 18*a* outwardly extending in a radial direction from the periphery of the rotation shaft 20 of the main shaft 18, and a catch lever pin 18*b* formed as a protrusion protruded from a surface of the catch lever 18*a*.

Figure 6:
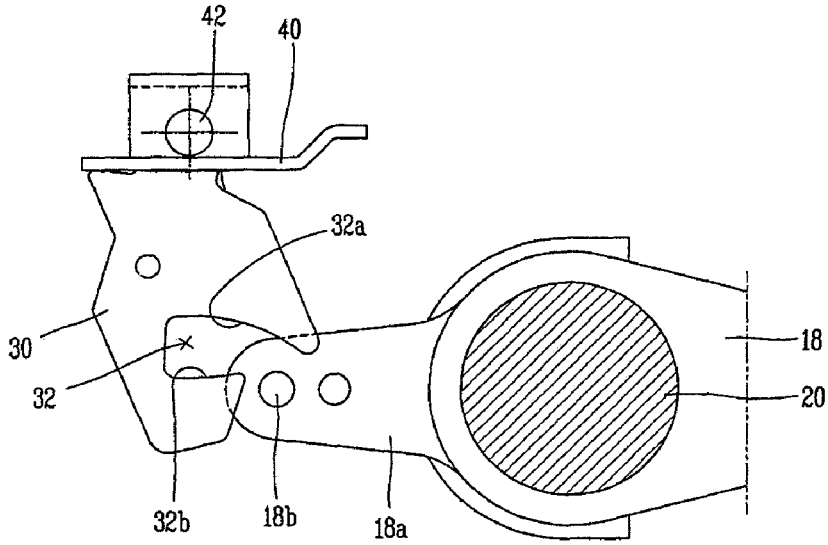
FIG. 6 is an enlarged side view showing a rebound catch portion of the embodiment shown in FIG. 5.

Meanwhile, referring to FIG. 6, a fixed bracket 40 may be installed within a main body of the circuit breaker, and a rebound catch 30, which is located near the is catch lever 18*a* and serves as a rebound preventer, may be installed to be freely rotatable about a hinge shaft 42. In FIG. 6, the rebound catch 30 is formed of a material in a shape of a thin plate, and disposed downwardly in FIG. 6 by its own weight in a state of no external force applied thereto.

The rebound catch 30 may be provided with a stopping groove 32 having a width widened from an inlet thereof toward the inside. Two facing surfaces of the stopping groove 32 are referred to as a first contact surface 32*a* and a second contact surface 32*b*. Here, an end of the first contact surface 32*a* may be located more outwardly than an end of the second contact surface 32*b*, namely, further protruded toward the main shaft 18. Also, the surface of the first contact surface 32*a* is formed in a curved line, which is curved toward the catch lever pin 18*b*. The curved line is formed in an arcuate shape; however, it may be a continuous curved line in various shapes.

An operation of the circuit breaker 100 according to the embodiment will now be described with reference to FIGS. 7 to 10.

Figure 7:
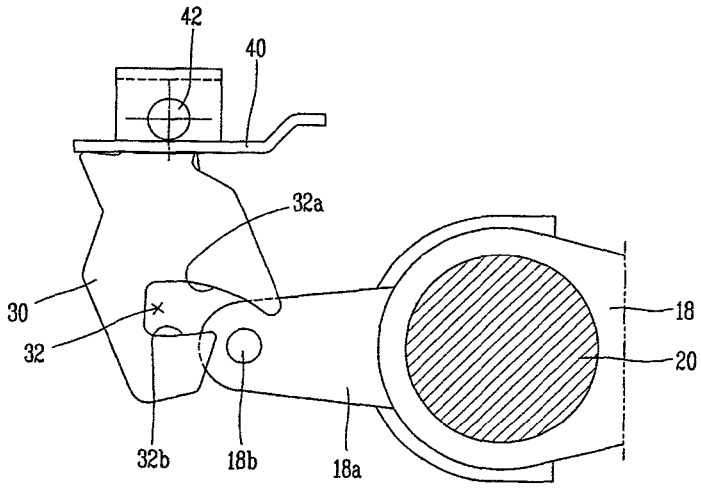
FIGS. 7 to 10 are explanatory views showing an operation process of the embodiment shown in FIG. 5.
Figure 8:
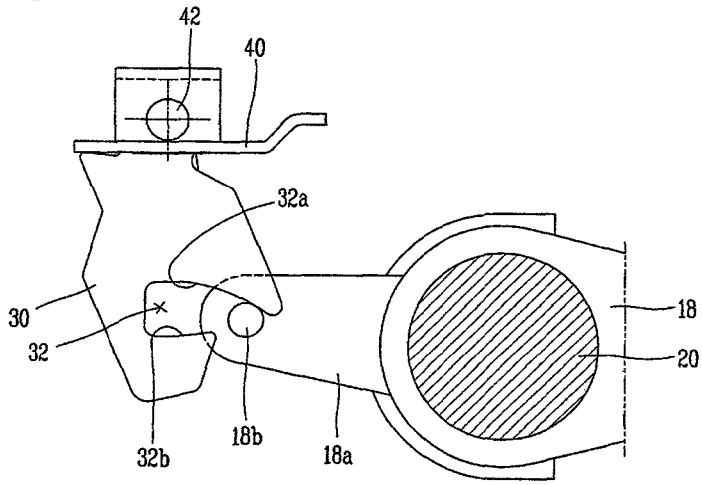

FIG. 7 shows a state before a trip operation is done. In this state, no external force is applied to the rebound catch 30. Accordingly, the rebound catch 30 is disposed downwardly by its own weight. Afterwards, upon a trip operation being executed, the main shaft 18 is rotated in a clockwise direction. In response to this rotation, the catch lever pin 18*b* comes in contact with the first contact surface 32*a* within the protrusion groove 32. When the main shaft 18 is continuously rotated, the rebound catch 30 is rotated by the catch lever pin 18*b* in a counterclockwise direction as shown in FIG. 8, and the catch lever pin 18*b* is cooperatively inserted into the stopping groove 32.

Figure 9:
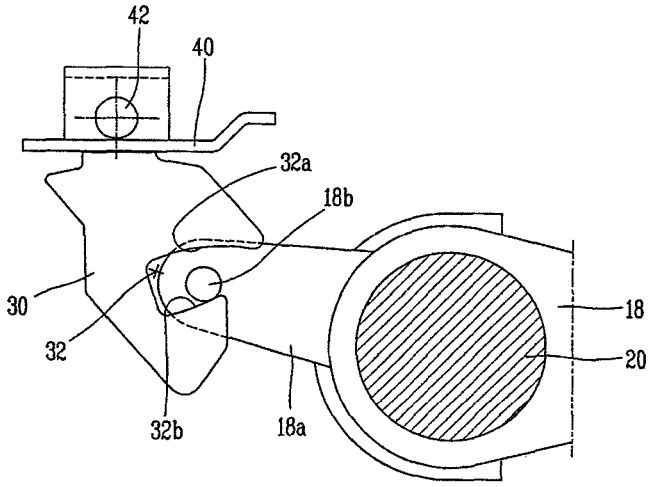
Figure 10:
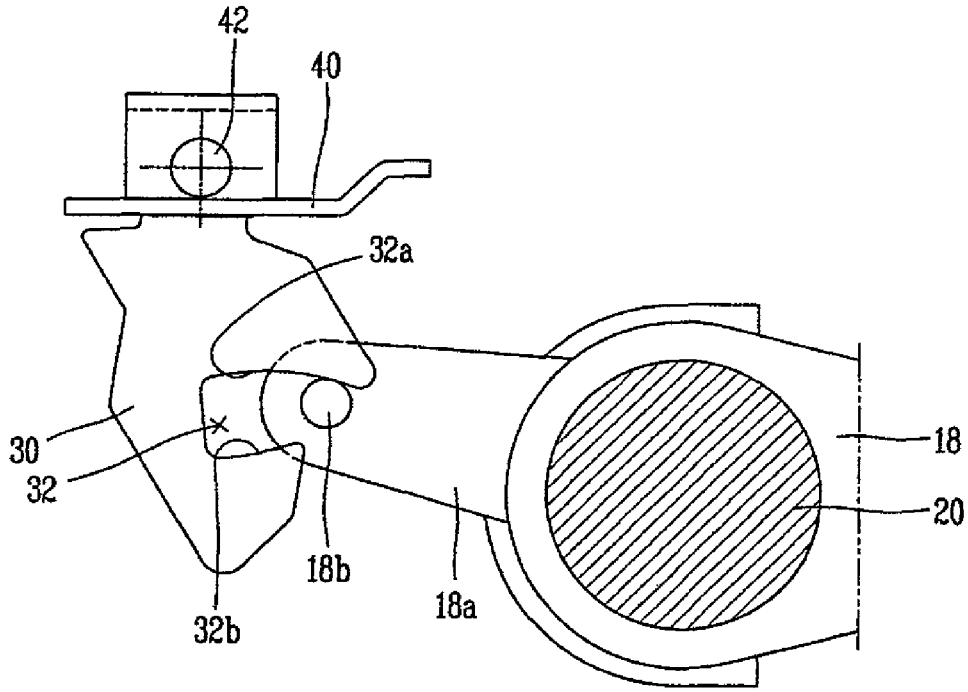

When the main shaft 18 is rotated to the maximum after the completion of is the trip operation, as aforementioned, the main shaft 18 is rotated in the counterclockwise direction due to a repulsive force or the like of the contact spring 16 and the trip spring 22, but, as shown in FIG. 9, the catch lever pin 18*b* comes in contact with the second contact surface 32*b*. Accordingly, the counterclockwise rotation of the main shaft 18 is stopped, and thereby the rebound of the main shaft 18 is fast restricted within a prescribed range. Here, the clockwise rotation of the main shaft 18 is referred to as a forward rotation, and the counterclockwise rotation is referred to as a reverse (backward) rotation.

Expatiating the rebounding operation of the main shaft 18, just after the main shaft 18 performs the forward rotation to the maximum by the trip operation, it is rotated backwardly at very fast speed by the repulsive force. Accordingly, even before the rebound catch 30 starts rotated in the clockwise direction, the main shaft 18 is rotated backwardly, so as to come in contact with the second contact surface 32*b* in the state of the rebound catch 30 being maximally rotated in the counterclockwise direction. Even under this state, the main shaft 18 applies a force toward the rebound catch 30, but such force is applied in a direction of passing through the center of the hinge shaft 42 of the rebound catch 30. Hence, the force applied from the main shaft 18 toward the rebound catch 30 cannot generate a torque for rotating the rebound catch 30.

Consequently, the force applied by the main shaft 18 is attenuated by a repulsive force applied by the hinge shaft 42, so the main shaft 18 cannot be rotated any more, resulting in providing an effect of preventing rebound. In other words, the main shaft 18 is unable to be rotated in the state where the catch lever pin 18*b* comes in contact with the second contact surface 32*b*.

In the meantime, the second contact surface 32*b* may be contactable with is the catch lever pin 18*b* only when the rebound catch 30 is rotated over a prescribed range.

The rotation-restricted main shaft 18 by the rebound catch 30 is then re-rotated forwardly by the forces of the contact spring 16 and the trip spring 22, so as to be consequently kept contacted with the first contact surface 32*a* as shown in FIG. 8.

Afterwards, in order to contact the movable contact with the fixed contact to reconnect the circuit after the release of the rotation-restricted state, upon backwardly rotating the main shaft 18 by means of the trip mechanism, the main shaft 18 is rotated in the state of the first contact surface 32*a* being contacted with the catch lever pin 18*b*. Hence, the main shaft 18 can be smoothly rotated in the reverse direction.

In this embodiment, the rebound quantity may be optionally decided by a person skilled in the art by adjusting the width of the stopping groove, the length of the second contact surface and the like. In addition, the rebound catch may be operated by its own weight without separately requiring a mechanism such as a spring, so any problem, such as the change in the property of its operation, may not occur in spite of a long-term use.

Figure 11:
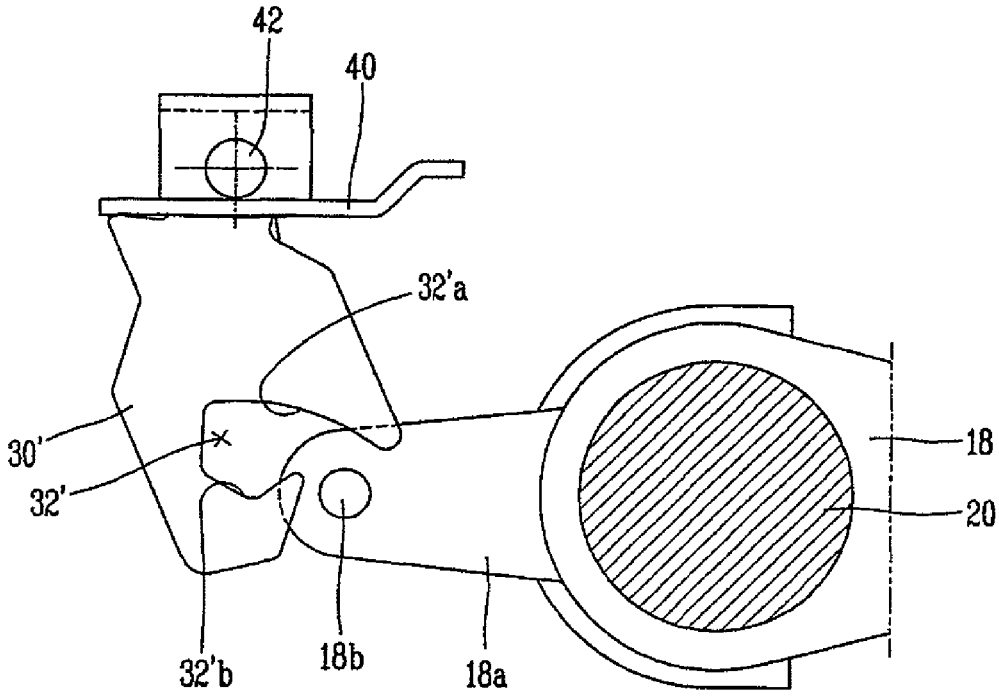
FIG. 11 is a side view showing another embodiment of the rebound catch.

Meanwhile, the second contact surface of the rebound catch may be configured as the continuous surface as shown in the embodiment of FIG. 5; however, it may not be limited to the configuration. A non-continuous surface, for example, a stopping jaw, for restricting the motion of the catch lever pin 18*b*, may further be provided in order to stop the reverse rotation of the main shaft more rapidly and accurately. That is, as shown in FIG. 11, an example may be considered that a second contact surface 32*b*' of a rebound catch 30' may be configured as a non-continuous surface in a shape of two lines meeting together.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker comprising:

a main body;

a fixed contact fixed to the main body;

a movable contact contactable with or separated from the fixed contact, the movable contact being movably installed at the main body;

a main shaft connected to one side of the movable contact, the main shaft being rotatably installed on the main body;

a trip mechanism coupled to another side of the main shaft and configured to rotate the main shaft; and a rebound preventer having one end rotatably installed on the main body and provided with a stopping unit formed at another end thereof and engaged with the main shaft, wherein the stopping unit is provided with a stopping groove including first and second contact surfaces facing each other, wherein the first contact surface comes in contact with a part of the main shaft when separating the movable contact so as to rotate the rebound preventer in a direction opposite to the main shaft being rotated, wherein the second contact surface restricts a reverse rotation of the main shaft when the second contact comes in contact with the part of the main shaft in a state where the rebound preventer has been rotated over a prescribed range.

2. The circuit breaker of claim 1, wherein an end of the first contact surface extends more outwardly than an end of the second contact surface.

3. The circuit breaker of claim 2, wherein the first contact surface is configured as a curved surface with an arcuate shape.

4. A circuit breaker in which a trip mechanism and a movable contact are connected respectively to both ends of a main shaft, the main shaft rotatably installed in a main body, so as to perform a trip operation by transferring a tensile force of the trip mechanism to the movable contact, the circuit breaker comprising:

a stopping groove engaged with part of the main shaft; and a rebound preventer rotatably installed in the circuit breaker, wherein the stopping groove comprises first and second contact surfaces contactable with the part of the main shaft upon the rotation of the main shaft, wherein an extending line of a force applied from the part of the main shaft to the second contact surface passes through the center of the rotation of the rebound preventer upon a reverse rotation of the main shaft.

5. The circuit breaker of claim 4, wherein the main shaft is provided with a protrusion inserted into the stopping groove upon the forward and reverse rotations thereof.

* * * * *